United States Patent [19]

Mullay

[11] Patent Number: 4,775,431

[45] Date of Patent: Oct. 4, 1988

[54] MACROEMULSION FOR PREPARING HIGH DENSITY EXPLOSIVE COMPOSITIONS

[75] Inventor: John J. Mullay, Luzerne, Pa.

[73] Assignee: Atlas Powder Company, Dallas, Tex.

[21] Appl. No.: 123,946

[22] Filed: Nov. 23, 1987

[51] Int. Cl.[4] ..... C06B 45/34

[52] U.S. Cl. ..... 149/8; 149/2; 149/21; 149/46; 149/61; 149/109.6

[58] Field of Search ..... 149/2, 8, 21, 46, 61, 149/109.6, 21

[56] References Cited

U.S. PATENT DOCUMENTS

| | | | |
|---|---|---|---|
| 3,004,842 | 10/1961 | Rowlinson | 52/14 |
| 3,052,578 | 9/1962 | Davis, et al. | 149/60 |
| 3,111,437 | 11/1963 | Hino et al. | 149/21 |
| 3,124,495 | 3/1964 | Hradel | 149/43 |
| 3,139,029 | 6/1964 | Bjork | 102/23 |
| 3,161,551 | 12/1964 | Egly et al. | 149/46 |
| 3,164,503 | 1/1965 | Gehrig | 149/18 |
| 3,231,437 | 1/1966 | Berthmann et al. | 149/101 |
| 3,242,019 | 3/1966 | Gehrig | 149/18 |
| 3,249,477 | 5/1966 | Clay et al. | 149/41 |
| 3,264,151 | 8/1966 | Schrieber et al. | 149/41 |
| 3,275,485 | 9/1966 | Egly | 149/47 |
| 3,282,753 | 1/1966 | Cook et al. | 149/46 |
| 3,288,661 | 11/1966 | Swisstack | 149/60 |
| 3,307,986 | 3/1967 | Grant | 149/21 |
| 3,326,734 | 6/1967 | Slykhouse | 149/41 |
| 3,347,722 | 10/1967 | Gordon | 149/41 |
| 3,379,587 | 4/1968 | Cook | 149/39 |
| 3,447,978 | 6/1969 | Bluhm | 149/2 |
| 3,715,247 | 2/1973 | Wade | 149/21 |
| 3,764,421 | 10/1973 | Clark | 149/46 |
| 3,765,964 | 10/1973 | Wade | 149/2 |
| 3,943,820 | 3/1976 | Persson | 86/20 |
| 3,956,040 | 5/1976 | Tezuka | 149/41 |
| 4,111,727 | 5/1978 | Clay | 149/2 |
| 4,141,767 | 2/1979 | Sudweeks et al. | 149/2 |
| 4,181,546 | 1/1980 | Clay | 149/21 |
| 4,294,633 | 10/1981 | Clay | 149/2 |
| 4,310,364 | 1/1982 | Ekman et al. | 149/2 |
| 4,310,364 | 1/1982 | Ekman et al. | 149/2 |
| 4,323,967 | 6/1982 | Cartwright | 149/2 |
| 4,357,184 | 11/1982 | Binet et al. | 149/2 |
| 4,426,238 | 1/1984 | Wasson | 149/2 |
| 4,490,195 | 12/1984 | Cooper et al. | 149/2 |
| 4,500,369 | 2/1985 | Tag et al. | 149/2 |
| 4,509,998 | 4/1985 | Hajto | 149/2 |
| 4,555,278 | 11/1985 | Cescon et al. | 149/21 |
| 4,585,495 | 4/1986 | Honeyman et al. | 149/2 |

FOREIGN PATENT DOCUMENTS

| | | |
|---|---|---|
| 281537 | 3/1967 | United Kingdom . |
| 1306546 | 2/1973 | United Kingdom . |

OTHER PUBLICATIONS

"Ammonium Nitrate Explosives Some Experimental Mixes", by R. V. Coxon, Paper No. 9 from *The Australasian Institute of Mining and Metallurgy.*

"The Use of Surface Active Agents to Sensitize AN/FO Mixtures", by R. W. Coxon, Paper No. 3 from *The Australasian Institute of Mining and Metallurgy.*

*Primary Examiner*—Stephen J. Lechert, Jr.

*Attorney, Agent, or Firm*—Richards, Harris, Medlock & Andrews

[57] ABSTRACT

The present invention provides a water-in-oil macroemulsion for use in combination with a solid oxidizer in preparing a high density explosive composition. The macroemulsion comprises 1–70% by weight of water, 5–85% by weight of a fuel oil, and 0.1–10% by weight of an emulsifier with an HLB number within the range 0–8. The invention also provides an explosive composition comprising 2–20% by weight of a water-in-oil macroemulsion as just described and 80–98% by weight of a solid oxidizer. The preferred solid oxidizer is selected from the group of ammonium nitrate, sodium nitrate, potassium nitrate, calcium nitrate, ANFO, and mixtures thereof. In addition, water soluble fuels, oil soluble fuels, or solid fuels may be added to the erxplosive composition. The invention further provides a method of preparing a solid oxidizer based explosive having a higher density than that obtainable in a mixture of fuel oil and the solid oxidizers.

23 Claims, No Drawings

MACROEMULSION FOR PREPARING HIGH DENSITY EXPLOSIVE COMPOSITIONS

TECHNICAL FIELD

The present invention relates to a water-in-oil macroemulsion for use in preparing a high density explosive composition. The macroemulsion comprises 1–70% by weight of water, 5–85% by weight of a fuel oil, and 0.1–10% by weight of an emulsifier. When mixed with a solid oxidizer such as ammonium nitrate prills, the macroemulsion and solid oxidizer form an explosive composition that has a higher density than that attainable in a mixture of fuel oil and the solid oxidizer. The macroemulsion may be mixed with a solid oxidizer at the blast site and delivered to the borehole using equipment currently used for ANFO.

BACKGROUND OF THE INVENTION

The invention relates to a water-in-oil macroemulsion for use in combination with a solid oxidizer in preparing explosive compositions. When combined with a solid oxidizer, the macroemulsion and oxidizer form an explosive composition having a density greater than that achievable by simply using fuel oil by itself with the solid oxidizer.

Mixtures of ammonium nitrate (AN) and diesel fuel oil (FO) have been used for many years in the explosives industry, and the mixture has come to be known as ANFO. Typically, ammonium nitrate in prill form is mixed with diesel fuel oil in the ratio of about 94 to 6 AN:FO. ANFO is inexpensive and is widely used in various kinds of blasting, but its relatively low bulk density (about 0.8 g/cc) limits the amount of useful energy that can be obtained per borehole. A higher density product would provide more energy per borehole. ANFO also becomes desensitized by water, thereby precluding its use in water-filled boreholes.

Various attempts have been made to increase the density or bulk strength of ANFO, and thereby provide more energy per volume. Some examples of these attempts include the use of high density additive fuels (e.g., ferrophosphorous), crushing the ammonium nitrate, and using thickened water-based AN slurries. These attempts have met with limited success. The use of high density fuels require special equipment for addition of the fuels to the prills which increases the cost of the explosive. Similarly, special equipment and extra personnel are required for partially crushing the prills which also leads to increased costs. Slurries have the problem of lacking sensitivity and require the addition of sensitizing agents as well as the use of additional equipment.

U.S. Pat. No. 3,764,421 describes one such attempt to solve the density problem of ANFO that includes the addition of water in controlled amounts to a prilled AN-fuel oil mixture. The mixture is aged for a period of time (typically 10 to 14 days) and then stirred to break down the AN into finely divided solids. This approach achieves essentially the same result as partially crushing the prills but uses aging instead of special equipment to accomplish the result. Extra time and equipment are required to gain an increase in density. A need still exists, therefore, for a method and formulation to increase the density of a solid oxidizer-based explosive composition over that obtainable with ANFO without the use of special equipment or a lengthy aging process. It would be highly desirable to have a solid oxidizer-based explosive that has a greater density than ANFO but could be mixed and loaded using the equipment presently available and used in mixing and loading ANFO. The present invention meets this need by providing a water-in-oil macroemulsion to be used with a solid oxidizer such as ammonium nitrate prills to provide a high density explosive.

The explosives art has used water-in-oil emulsions in formulating various types of explosive compositions. Almost always, the emulsion consists of an aqueous solution of oxidizing salts as the discontinuous phase, diesel fuel oil as the continuous phase, and an emulsifier. U.S. Pat. No. 3,447,978 to Bluhm discloses a water-in-oil emulsion explosive comprising a solution of oxidizing salts as the discontinuous aqueous phase, a fuel, an emulsifier, and occluded gas to lower the density of the emulsion and increase the sensitivity. Without the occluded gas, the emulsion is not detonable in useful diameters. Later patents, such as U.S. Pat. No. 3,765,964 disclose emulsions that include sensitizers such as strontium in addition to occluded gas to increase the sensitivity of the emulsion.

Numerous other patents also describe explosive emulsions that incorporate oxidizing agents in the aqueous phase of the emulsion. U.S. Pat. No. 3,161,551 to Egly, et al. discloses a water-in-oil emulsion containing 50–70% by weight of ammonium nitrate, 15–35% water, 5–20% of an organic sensitizer and a small amount of emulsifiers. Egly teaches to combine this AN-based emulsion with particulate ammonium nitrate so as to fill all the spaces between the particles. U.S. Pat. No. 3,356,547 to Berthmann, et al. describes an emulsion containing nitroglycerine that is used in combination with solid AN particles.

Clay in U.S. Pat. No. 4,111,727 discloses an explosive composition formed by mixing 10–40% of a water-in-oil emulsion containing an oxidizer salt dissolved in the aqueous phase with 60–90% of solid oxidizer such as ammonium nitrate prills. The emulsion and oxidizer are mixed such that sufficient air is left in the interstitial spaces of the solid oxidizer to render the mixture detonable. The emulsion does not need to contain occluded gas.

Clay in U.S. Pat. No. 4,181,546 discloses a waterproof explosive comprising 40–60% by weight of a solid, particulate oxidizer salt and 60–40% of a water-in-oil emulsion containing an oxidizer salt dissolved in the aqueous phase The emulsion also contains a density controlled sensitizer such as hollow glass beads, polystyrene beads, microballoons or the equivalent. The components are thoroughly mixed together to substantially eliminate the voids between the solids.

In a later patent, U.S. Pat. No. 4,294,633, Clay discloses a blasting composition comprising 60–90% by weight of solid particulate oxidizer salt and 10–40% of a liquid slurry partially filling the interstices and voids between the solid particles. The slurry is a substantially saturated and thickened solution of strong oxidizer salt and does not appreciably dissolve or soften the granules.

A disadvantage of water-in-oil emulsions in which the aqueous phase contains dissolved oxidizer salts is that the emulsions are highly viscous compared to diesel fuel oil and require special equipment and handling. Also, such emulsions are relatively unstable and will separate or "break" into different phases with time or with temperature cycling. When emulsions such as those described in the Clay, U.S. Pat. Nos. 4,181,546 and 4,111,727 are used, they are generally stored separately until mixed with the solid oxidizer particles. In order to prevent phase separation in cold climates, it is usually necessary to heat the emulsion continuously from the time of production until the time of use to prevent the oxidizer salt from crystallizing in the aqueous phase. These same disadvantages are characteristic of almost all of the emulsions currently used in the explosive industry as almost all of them exhibit limited stability over time and sensitivity to low temperatures.

U.S. Pat. No. 4,555,278 to Cescon, et al. describes a relatively stable blend of nitrate particles and a water-in-oil emulsion comprising an aqueous solution of oxidizing salts, a liquid fuel, and an emulsifying agent. The blend also contains a sensitizing amount of dispersed gas bubbles or voids. The patent is directed towards forming a composition that minimizes the transfer of water from the aqueous phase across the continuous phase to the nitrate particles.

Another example of a water-in-oil emulsion explosive is disclosed in U.S. Pat. No. 4,357,184 to Binet. The disclosed emulsions comprise an aqueous solution of at least one oxygen supplying salt as a discontinuous phase, a liquefiable carbonaceous fuel as a continuous phase, a sensitizing component and a blend of emulsifying agents. Binet describes these emulsions as "ultra-stable colloidal dispersions" and uses the term microemulsion. As used by Binet, the term microemulsion describes a liquid-liquid foam of very small cell size ranging from about 1 micron to about 15 microns. In the emulsion art, however, the term microemulsion means something different than that used by Binet. What Binet termed a microemulsion is more properly termed a small cell macroemulsion.

Australian patent No. 281,537 to Coxon describes an oil-in-water emulsion containing an anionic surface active agent that is mixed with AN prills. Coxon prefers AN prills that are processed so as to have a high oil absorption. Coxon only discloses the use of an oil-in-water emulsion formed by using anionic surface active agents in the amount of 2.5% to about 7.5% by weight of the emulsion. Coxon teaches that nonionic surface active agents produce caking of the ANFO mixture and the product loses its free-flowing properties. Coxon states that cationic surface active agents are not generally used because some of them liberate ammonia which affects the ammonium nitrate. The HLB values for the surfactants disclosed in Coxon are relatively high and range from about 11 to as high as 40. Coxon discovered that he could improve the sensitivity of ANFO by adding a small amount of water and distributing it with the oil in the form of an emulsion over the ammonium nitrate prills. In this manner, Coxon desired to achieve greater intimacy between the oil and the AN thereby achieving greater sensitivity. Coxon used an oil-in-water emulsion with anionic surfactants to accomplish these results.

The anionic surfactants disclosed in Coxon produce almost exclusively oil-in-water emulsions. These emulsions are not as suited for use in combination with a solid oxidizer as a replacement for ANFO as are the water-in-oil emulsions of the present invention. The oil-in-water emulsions disclosed in Coxon are useful only over a relatively narrow range of temperatures. Since water is the continuous phase, Coxon's emulsions have a separation temperature and freezing point of about 0° C. In contrast, the water-in-oil emulsions of the present invention exhibit a much lower separation temperature, as low as −30° C. and lower, and therefore, have a much broader useful range. As mentioned, one of the problems of previously known emulsion-type explosive systems is the need to keep them heated to prevent separation of the emulsion in cold climates. Coxon's emulsions would also require constant heating to prevent freezing and the separation of the emulsion at temperatures below the freezing point of water. Another problem with Coxon's emulsions is that they could not be used with the same equipment and piping systems as currently used for ANFO. This equipment is almost exclusively made of iron or steel which would be subject to severe corrosion if used with Coxon's emulsions in which water is the external phase. These corrosion problems are minimized with the water-in-oil emulsions of the present invention.

The present invention provides an explosive composition that can be used as a replacement for ANFO, or in combination with ANFO, while using the same equipment and essentially the same processes as are currently used for ANFO and providing an explosive composition with a greater density and bulk strength than ANFO. These features result in a very desirable explosive composition.

SUMMARY OF THE INVENTION

The present invention provides a water-in-oil macroemulsion for use in preparing a high density explosive composition. The macroemulsion comprises 1–70% by weight of water, 5–85% by weight of fuel oil, and 0.1–10% by weight of an emulsifier with an HLB number within the range 0–8. In a preferred embodiment, the macroemulsion comprises 20–65% by weight of water, 30–75% by weight of fuel oil and 0.2–5% by weight of a nonionic emulsifier.

The invention also provides an explosive composition comprising 2–20% by weight of the water-in-oil macroemulsion as described above and 80–98% by weight of a solid oxidizer. In a preferred embodiment, the solid oxidizer is selected from ammonium nitrate, sodium nitrate, potassium nitrate, calcium nitrate, ANFO, and mixtures thereof. It is also preferred that the oxidizer be in prill form. It is further preferred that the explosive be oxygen balanced within the range −20 to +20, and most preferably within the range −2 to +2. In order to achieve a desirable oxygen balance, fuels in various forms may be added to the explosive composition. These additive fuels may be water soluble, oil soluble, or solid fuels.

Also included in the present invention is a method for providing an explosive composition containing a solid oxidizer and having a higher density than that achievable by using only fuel oil with the solid oxidizer as in ANFO. The method comprises mixing a water-in-oil macroemulsion as described above with a solid oxidizer so as to adequately coat the oxidizer and allow the water contained within the macroemulsion to contact the oxidizer.

DETAILED DESCRIPTION

The present invention includes a formulation and a method for providing an explosive composition that contains a solid oxidizer such as ammonium nitrate prills while achieving a higher density than a mixture of fuel oil and oxidizer such as ANFO. The invention provides a water-in-oil macroemulsion which can be mixed with a solid oxidizer at the blast site and delivered to the borehole using current equipment and processes available and known to users of ANFO.

The emulsions included in the present invention are generally described as "macroemulsions" and comprise the combination of water, oil, and an emulsifier. These emulsions are designed to form an explosive composition when combined with a solid oxidizer. These macroemulsions may also be prepared to handle in a manner that is similar to diesel fuel oil thereby allowing use of equipment currently used for ANFO.

The components of the macroemulsions of the present invention may be given in weight percent as follows: water 1–70%, oil 5–85%, and 0.1–10% of an emulsifier with an HLB value within the range 0–8. Most preferably, the macroemulsion comprises 20–65% by weight of water, 30–75% by weight of fuel oil and 0.2–5% by weight of a nonionic emulsifier. The emulsion may also contain other components such as additive fuels, e.g., methanol and hexanol. The order of mixing the components can be important in forming the emulsion. From a practical standpoint, any solid components should first be dissolved in either the water or the oil phase. The emulisifer is dissolved in the oil phase, and then the mixture is added to water while mixing. In some cases, it may be desirable to form the emulsifier insitu.

As known in the emulsion art, macroemulsions have a discontinuous or a dispersed phase usually in the form of droplets that are held within the continuous phase. The droplets typically range in diameter from about 1 micron to as high as 100 microns and greater. As included in the present invention, the macroemulsions will generally have a droplet diameter of 1–50 microns, but at times, the droplets may be smaller than 1 micron, as low as 0.1 micron, and may be greater than 50 microns. As used herein, a droplet refers to a cell of the discontinuous phase, and the diameter is the width across the cell.

The emulsifiers that are suitable for use in the present invention are the water-in-oil type, i.e., those which will form a water-in-oil emulsion from water, fuel oil and other components. These emulsifiers are generally described in terms of the hydrophile-lipophile balance or HLB. Generally, the HLB of the water-in-oil emulsifiers are within the range 0 to about 8. These emulsifiers are typically nonionic but can also be anionic or cationic. Mixtures of compatible emulsifiers may also be used as long their combined HLB is within the proper range.

Emulsifiers with an HLB of 8 or less are known in the explosives art as well as the emulsion art. Examples of emulsifiers that can be used in the present invention are disclosed in U.S. Pat. Nos. 3,447,978; 3,715,247; 3,765,964; and 4,141,767; the disclosures of which are hereby incorporated by reference. In addition, acceptable emulsifiers may be found in the standard reference work McCutcheon's Emulsifiers and Detergents (McCutcheon Division, M.C. Publishing Co., New Jersey). Specific emulsifiers that can be used include those derivable from sorbitol by esterification with removal of water. Such sorbitan emulsifying agents may include sorbitan fatty acid esters such as sorbitan monolaurate, sorbitan monooleate, sorbitan monopalmitate, sorbitan monostearate and sorbitan tristearate. The mono- and glycerides of fat-forming fatty acids are also useful as water-in-oil type emulsifying agents. Other water-in-oil type emulsifying agents which may be used in the present invention include polyoxyethylene sorbitol esters such as the polyoxyethylene sorbitol beeswax derivative materials. Water-in-oil type emulsifying agents such as the isopropyl esters of lanolin fatty acids may also prove useful as may mixtures of higher molecular fatty alcohols and wax esters. Various other specific examples of water-in-oil type emulsifying agents include polyoxyethylene$_{(4)}$ lauryl ether, polyoxyethylene$_{(2)}$ oleyl ether, polyoxyethylene$_{(2)}$ stearyl ether, polyoxyalkylene oleyl laurate, oleyl acid phosphates, substituted oxazolines and phosphate esters, to list but a few. Mixtures of these various emulsifying agents as well as other water-in-oil type emulsifying agents may also be used.

In contrast to the above described emulsifiers, the emulsifiers disclosed in Coxon are those designed to form oil-in-water emulsions and have HLB numbers in the range of 11 to about 40. These surfactants cannot typically be used to form a water-in-oil emulsion as those used in the present invention.

Various types of organic oils may be used as the fuel oil in the present invention including a wide range of petroleum distillates, vegetable oils and mineral oils. Diesel fuel oil is the most commonly used in the explosive art as it is inexpensive and readily available. An advantage of the present invention is that the macroemulsion may be prepared to handle much the same as diesel fuel oil is handled in the preparation of ANFO. The viscosity of the macroemulsion is similar to diesel fuel oil so that the same equipment may be used in forming the macroemulsion and mixing it with a solid oxidizer as is used for the preparation of ANFO. It would be desirable, therefore, that any other oil used in the macroemulsion have a viscosity or is modified to have a viscosity similar to diesel fuel oil.

Additionally, other components may be included in the macroemulsions of the present invention such as water-soluble or oil-soluble fuels that may be added to the water or oil phases prior to formation of the emulsion. Examples of such additional components include methanol, hexanol, acetates, ethylene glycol, and inorganic nitrates. The chemical nature and amount of such added material is limited only by the ability of the emulsifier to solubilize the water and oil phases. Additives may also be included to improve the low temperature stability of the emulsion. Other additives may be included to adjust the oxygen balance of the resulting explosive composition when the macroemulsion is added to a solid oxidizer.

The present invention also includes an explosive composition comprising the mixture of a macroemulsion as described above with a solid oxidizer. The oxidizer is mixed with the macroemulsion so as to adequately coat the oxidizer with the fluid. As mentioned, this may be accomplished using the same equipment now used to mix ANFO. The preferred oxidizer is a nitrate selected from ammonium nitrate, sodium nitrate, potassium nitrate, calcium nitrate, ANFO or mixtures thereof. Typically ammonium nitrate is used by itself or in combination with the other nitrates. The solid oxidizer may be virtually in any form such as flakes, grinds, prills, particles, blocks, or balls, with the preferred form being prills. It is preferred that the solid oxidizer be in particles that are about the same size as AN prills, about ¼ inch in diameter or smaller. Larger particles may result in an explosive that is nondetonable or is useful only in the larger diameter boreholes. The most preferred solid oxidizer is ammonium nitrate prills which also includes ANFO formulations. The solid oxidizer may comprise a mixture of two or more oxidizers. A macroemulsion as described above may be added to the solid oxidizer in the amount of 2–20% by weight of the total composition with the remaining 80–98% comprising the solid oxidizer. At an emulsion level above about 15% by weight of the composition, the use of the explosive may be limited to larger diameter boreholes, generally, those of more than 12 inches in diameter. Of course, as the level of water increases as a percentage of the total explosive composition, the water will tend to desensitize the oxidizer and the compoiition will be useful only in larger size boreholes.

In addition to a solid oxidizer, the explosive compositions may include a solid fuel mixed in with the oxidizer. Examples of such solid fuels include coal, ferrophosphorus, aluminum, urea, sawdust, gilsonite, sugar, and mixtures thereof. These solid fuels may be mixed in with the solid oxidizer before, during or after the oxidizer is mixed with the emulsion.

When the macroemulsions of the present invention are mixed with solid oxidizers, the macroemulsions act upon the solids to produce an explosive composition with a higher density than that achievable with simply fuel oil and the solid oxidizer. The density of the explosive composition increases as the water in the fluid system is absorbed by the solid oxidizer, and the solid oxidizer is partially dissolved in the water. Thus, the present invention also provides a method for producing an explosive composition containing a solid oxidizer and having a higher density than that achievable with simply fuel oil and the solid oxidizer.

The energy available from an explosive composition depends on a number of factors, but most significantly upon the oxygen balance of the composition. Generally, the closer the oxygen balance is to zero, the higher the available energy. Thus, the oxygen balance is a measure of the potential efficiency of the explosive system. It is preferred that the oxygen balance of the explosive compositions of the present invention fall within the range −20 to 20, and most preferably within the range −2 to 2. Various components may be adjusted as known in the explosives art so that the oxygen balance falls within this range. Usually, the ratio of fuel to oxidizer is the controlling factor for the oxygen balance. The type of oxidizer may also influence the balance. For example, sodium and potassium nitrates are more oxygen positive than ammonium nitrates and therefore would require more fuel in the explosive composition to get an acceptable oxygen balance. If ANFO is used as a solid oxidizer, less fuel may be used in the macroemulsion. If a low percentage of macroemulsion is used in the explosive composition (2–5%) then the macroemulsion should contain more fuel in order to provide an oxygen balanced explosive. Again, a fuel may be added to the explosive and it may be a liquid or solid dissolved in either the water or oil phases of the emulsion, or it may be a solid fuel that is mixed with the solid oxidizer.

Other considerations that enter into the selection of the percentage of components comprising the macroemulsion include the intended use, porosity of the solid oxidizer, cost, and the limits of the emulsifier to solubilize the water and oil. If the macroemulsion is intended for use in a cold climate, then it may be desirable to provide an emulsion with a lower separation or "break" temperature. This is done by forming an emulsion with smaller droplets or by adding watermiscible fuels such as methanol or by adding salts such as sodium acetate that lower the freezing temperature of water. It is also possible to adjust the separation temperature by using a combination of surfactants. The porosity of the solid oxidizer also influences the makeup of the macroemulsion. The more porous the solid, the more liquid it will absorb, and thus, the more liquid is needed in the composition to fill the interstitial voids between the prills as well as the pores within the prills. Cost is another factor that influences the makeup of the emulsion. Diesel fuel oil is less expensive than most other oils, and therefore, is the most commonly used fuel oil.

The following Examples describe the present invention and its associated advantages in more detail. The results are shown in Tables 1 and 2.

EXAMPLE 1

A macroemulsion was formed using 27.5 grams of diesel fuel oil, 10 grams of water, and 0.3 grams of "Glycomul O", which is a tradename for a sorbitan monooleate emulsifier. Glycomul O has an HLB value of about 4. The emulsion was formed by first dissolving the emulsifier in the oil phase and then adding it with mixing to the water. In the laboratory, the emulsions may require 1–2 minutes mixing to form, but it is possible to form the emulsions in seconds in a continuous process. Any other emulsifying technique as known in the emulsion art may be used in forming the emulsion of the present invention. Once formed, the emulsion was added to 460 grams of ammonium nitrate prills and the mixture was stirred for a few seconds to insure that the prills were adequately coated with the macroemulsion. This mixture was then put into a 1,000 milliliter graduated cylinder to simulate a borehole and was observed over time. The initial height of the mixture was 590 milliliters with a density of .85 g/cc. This compares with the bulk density of ANFO which is normally about 0.8–0.82 g/cc. After 1 hour, the mixture had a height of 560 milliliters and a density of .89 g/cc. No change was noticed in the height of the density after 2 hours.

EXAMPLES 2–5

The procedures of Example 1 were repeated for Examples 2–5 except that the amount of water was increased by 10 grams in each successive example, and the amount of AN prills was decreased by 10 grams in each successive example. The components of the explosive compositions and the resulting density observations are recorded in Table I.

These examples illustrate that the higher the water content in the emulsion the greater the density rise. Even with only 10 grams of water, a significant increase occurs in the density of the explosive composition over ANFO within one hour. As the amount of water in the macroemulsion is increased, the density of the explosive composition increases even further. Similarly, as the amount of macroemulsion is increased relative to the solid oxidizer, the density of the resulting explosive composition also increases.

EXAMPLES 6–7

In these Examples, explosive compositions were prepared and detonation velocity measurements were taken on 5-inch diameter unconfined examples to observe detonation behavior. In Example 6, a macroemulsion was formed from 420 grams of diesel fuel oil, 152 grams of water and 38 grams of emulsifier using the techniques described in Example 1. Once the emulsion was formed, it was mixed with 7 kilograms of AN prills and mixed to sufficiently coat the prills with the emulsion. The explosive composition was loaded in a 5-inch diameter relatively unconfined cylinder and primed with a 3 x 5 inch high energy ammonia gelatin nitroglycerine explosive primer ("Power Primer") which was initiated by a No. 8 electric blasting cap. A detonation velocity of 3125 mps was recorded.

For Example 7, the emulsion was formed using 385 grams of diesel fuel oil, 280 grams of water and 35 grams of emulsifier. The emulsion was mixed with 6.3 kilograms of ammonium nitrate prills and packaged and tested as described in Example 6. A detonation velocity of 3255 mps was recorded. These results are shown in Table II.

EXAMPLE 8

For comparison, a mixture of ANFO was tested for detonation velocity. A mixture of 6.4 kilograms of AN prills and 409 grams of diesel fuel oil was combined in a manner as described above. The mixture was detonated in a manner similar to that for Examples 6 and 7. The detonation velocity was measured to be 3,060 mps. These results are shown in Table II. In comparison, Examples 6, 7, and 8 show that the explosive composition of the present invention detonates as well as or better than ANFO.

It is important to note that the macroemulsions of the present invention are relatively thin liquids which can be easily metered into the AN prills using currently used feeding equipment. Another important advantage is the density increasing action that is demonstrated when the macroemulsions are combined with solid oxidizers such as ammonium nitrate prills. This increase in density leads to increased energy available from the detonation of the explosive as shown from the results in Examples 6 and 7 in comparison to Example 8. The explosive compositions of the present invention demonstrate densities greater than that of ANFO under similar conditions. Indeed, densities of 1.2 g/cc and greater are achievable by the present invention.

The macroemulsions of the present invention are also relatively stable against separation which enhances the ability to use the macroemulsions under varying conditions. The macroemulsions are capable of withstanding relatively low temperatures without separating and are capable of withstanding normal handling in the processing and transportation of the emulsions from the production site to the blast site. Under normal conditions, these macroemulsions are stable for several hours at a minimum and can be stable for several days. With all of these advantages, the macroemulsions and explosive compositions of the present invention are very attractive to users of solid oxidizer based explosives. Having described but a few embodiments and advantages of the present invention, it will be apparent to those skilled in the art that modifications and adaptations may be made without departing from the scope of the invention.

TABLE I

| | EXAMPLES | | | | |
|---|---|---|---|---|---|
| | 1 | 2 | 3 | 4 | 5 |
| Emulsion: | | | | | |
| Diesel Fuel Oil (g) | 27.5 | 27.5 | 27.5 | 27.5 | 27.5 |
| Glycomul O (g) | 0.3 | 0.3 | 0.3 | 0.3 | 0.3 |
| Water (g) | 10 | 20 | 30 | 40 | 50 |
| Solid Oxidizer: | | | | | |
| AN prills (g) | 460 | 450 | 440 | 430 | 420 |
| Density: | | | | | |
| Initial (g/cc) | .85 | .93 | .98 | 1.04 | 1.16 |
| 1 Hour (g/cc) | .89 | .96 | 1.02 | 1.11 | 1.22 |

TABLE I-continued

| | EXAMPLES | | | | |
|---|---|---|---|---|---|
| | 1 | 2 | 3 | 4 | 5 |
| 2 Hour (g/cc) | .89 | .96 | 1.04 | 1.14 | 1.25 |

TABLE II

| | EXAMPLES | | |
|---|---|---|---|
| | 6 | 7 | 8 |
| Diesel Fuel Oil (g) | 420 | 385 | 409 |
| Emulsifier (g) | 38 | 35 | — |
| Water (g) | 152 | 280 | — |
| AN Prills (g) | 7000 | 6300 | 6400 |
| Detonation (mps) | 3125 | 3255 | 3060 |

I claim:

1. A water-in-oil macroemulsion for use in combination with a solid oxidizer in preparing a high density explosive composition, the macroemulsion consisting essentially of 1–70% by weight of water, 5–85% by weight of a fuel oil, and 0.1–10% by weight of an emulsifier with an HLB value within the range 0–8.

2. The macroemulsion of claim 1 wherein the emulsifier is selected from the group consisting of: sorbitan monolaurate, sorbitan monooleate, sorbitan monopalmitate, sorbitan monostearate, sorbitan tristearate, glycerides of fat-forming fatty acids, polyoxyethylene sorbitol beeswax derivatives, isopropyl esters of lanolin fatty acids, polyoxyethylene$_{(4)}$ lauryl ethers, polyoxyethylene$_{(2)}$ oleyl ethers, polyoxyethylene$_{(2)}$ stearyl ethers, polyoxyalkylene oleyl laurates, oleyl acid phosphates, oxazolines, phosphate esters, and mixtures thereof.

3. The macroemulsion of claim 1 wherein the macroemulsion comprises 20–60% by weight of water, 30–75% by weight of fuel oil, and 0.2–5% by weight of an emulsifier.

4. The macroemulsion of claim 1 wherein the emulsifier has an HLB value less than or equal to 4.

5. The macroemulsion of claim 1 further comprising a water soluble fuel.

6. The macroemulsion of claim 1 further comprising a fuel soluble in the fuel oil.

7. An explosive composition comprising 2–20% by weight of a water-in-oil macroemulsion and 80–98% by weight of a solid oxidizer, the macroemulsion consisting essentially of 1–70% by weight of water, 5–85% by weight of a fuel oil, and 0.1–10% by weight of an emulsifier with an HLB value within the range 0–8.

8. The explosive composition of claim 7 wherein the emulsifier is selected from the group consisting of: sorbitan monolaurate, sorbitan monooleate, sorbitan monopalmitate, sorbitan monostearate, sorbitan tristearate, glycerides of fat-forming fatty acids, polyoxyethylene sorbitol beeswax derivatives, isopropyl esters of lanolin fatty acids, polyoxyethylene$_{(4)}$ lauryl ethers, polyoxyethylene$_{(2)}$ oleyl ethers, polyoxyethylene$_{(2)}$ stearyl ethers, polyoxyalkylene oleyl laurates, oleyl acid phosphates, oxazolines, phosphate esters, and mixtures thereof.

9. The explosive composition of claim 7 wherein the fuel oil is diesel fuel oil.

10. The explosive composition of claim 7 wherein the solid oxidizer is selected from the group consisting of: ammonium nitrate, sodium nitrate, potassium nitrate, calcium nitrate, ANFO, and mixtures thereof.

11. The explosive composition of claim 7 further comprising an additive fuel selected from the group consisting of a water soluble fuel, an oil soluble fuel, a solid fuel, and mixtures thereof.

12. The explosive composition of claim 7 wherein the macroemulsion comprises 20–65% by weight of water, 30–75% by weight of fuel oil and 0.2–5% by weight of an emulsifier.

13. The explosive composition of claim 7 wherein the composition is oxygen balanced to within the range −20 to 20.

14. The explosive composition of claim 7 wherein the composition is oxygen balanced to within the range −2 to 2.

15. The explosive composition of claim 7 wherein the solid oxidizer is in prill form.

16. A method for providing an explosive composition containing a solid oxidizer and having a higher density than obtainable in a mixture of fuel oil and the oxidizer, the method comprising:

(a) forming a water-in-oil macroemulsion consisting essentially of 1–70% by weight of water, 5–85% by weight of a fuel oil, and 0.1–10% by weight of an emulsifier with an HLB value within the range 0–8, and (b) mixing the macroemulsion with a solid oxidizer to adequately coat the oxidizer and allow the water within the macroemulsion to contact the oxidizer.

17. The method of claim 16 wherein the solid oxidizer is selected from the group consisting of: ammonium nitrate, sodium nitrate, potassium nitrate, calcium nitrate, ANFO and mixtures thereof.

18. The method of claim 16 wherein the solid oxidizer is in prill form.

19. The method of claim 16 wherein the macroemulsion is 2–20% by weight of the resulting explosive composition and the solid oxidizer is 80–98% by weight of the explosive composition.

20. The method of claim 16 wherein the resulting explosive composition is oxygen balanced to within the range −2 to 2.

21. The method of claim 16 wherein the emulsifier is selected from the group consisting of: sorbitan monolaurate, sorbitan monooleate, sorbitan monopalmitate, sorbitan monostearate, sorbitan tristearate, glycerides of fat-forming fatty acids, polyoxyethylene sorbitol beeswax derivatives, isopropyl esters of lanolin fatty acids, polyoxyethylene$_{(4)}$ lauryl ethers, polyoxyethylene$_{(2)}$ oleyl ethers, polyoxyethylene$_{(2)}$ stearyl ethers, polyoxyalkylene oleyl laurates, oleyl acid phosphates, oxazolines, phosphate esters, and mixtures thereof.

22. The method of claim 16 wherein the macroemulsion further comprises an additive fuel.

23. The method of claim 16 further comprising mixing a solid fuel with a solid oxidizer prior to, during or after step (b).

* * * * *